US007299662B2

(12) United States Patent
Hielscher

(10) Patent No.: US 7,299,662 B2
(45) Date of Patent: Nov. 27, 2007

(54) ULTRASONIC CLEANING SYSTEM FOR CLEANING A PLURALITY OF PARALLEL EXTENDING, STRAND LIKE PRODUCTS, SUCH AS EXAMPLE WIRE, PROFILES AND PIPES

(75) Inventor: Holger Hielscher, Stahnsdorf (DE)

(73) Assignee: Hielscher Systems GmbH, Teltow (DE)

( * ) Notice: Subject to any disclaimer, the term of this patent is extended or adjusted under 35 U.S.C. 154(b) by 553 days.

(21) Appl. No.: 10/494,113

(22) PCT Filed: Oct. 31, 2002

(86) PCT No.: PCT/EP02/12179

§ 371 (c)(1),
(2), (4) Date: Apr. 30, 2004

(87) PCT Pub. No.: WO03/037538

PCT Pub. Date: May 8, 2003

(65) Prior Publication Data

US 2004/0250843 A1 Dec. 16, 2004

(30) Foreign Application Priority Data

Oct. 31, 2001 (DE) ..... 101 53 701

(51) Int. Cl.
*D06B 5/06* (2006.01)

(52) U.S. Cl. ..... 68/3 SS; 134/184

(58) Field of Classification Search ..... 68/3 SS; 134/184, 186
See application file for complete search history.

(56) References Cited

U.S. PATENT DOCUMENTS

| | | | | |
|---|---|---|---|---|
| 2,794,110 | A * | 5/1957 | Griffith | 219/69.12 |
| 4,016,436 | A * | 4/1977 | Shoh | 310/322 |
| 4,046,592 | A | 9/1977 | Westervelt et al. | |
| 4,100,926 | A | 7/1978 | Heim | |
| 4,205,213 | A * | 5/1980 | Inoue | 219/69.12 |
| 4,358,655 | A * | 11/1982 | Inoue | 219/69.17 |
| 4,383,159 | A * | 5/1983 | Inoue | 219/69.12 |
| 4,763,677 | A * | 8/1988 | Miller | 134/105 |
| 4,788,992 | A | 12/1988 | Swainbank et al. | |
| 5,228,282 | A * | 7/1993 | Tinsley et al. | 57/333 |
| 5,336,452 | A * | 8/1994 | Cohen et al. | 264/442 |

FOREIGN PATENT DOCUMENTS

| | | |
|---|---|---|
| DE | 19602917 C2 | 7/1997 |
| DE | 19706007 C1 | 7/1998 |

* cited by examiner

*Primary Examiner*—Frankie L. Stinson
(74) *Attorney, Agent, or Firm*—Kriegsman & Kriegsman

(57) ABSTRACT

The invention concerns an arrangement for ultrasound cleaning of several strandlike articles (4) traveling next to each other, such as, e.g., wires, profiles and pipes, by means of a liquid excited by ultrasound in a borehole (3), which is only slightly, i.e., around 5-50%, larger than the diameter of the article being cleaned, wherein the cleaning liquid is supplied to the boreholes (3) in such a way that it fills them completely.

10 Claims, 1 Drawing Sheet

Figure 1:
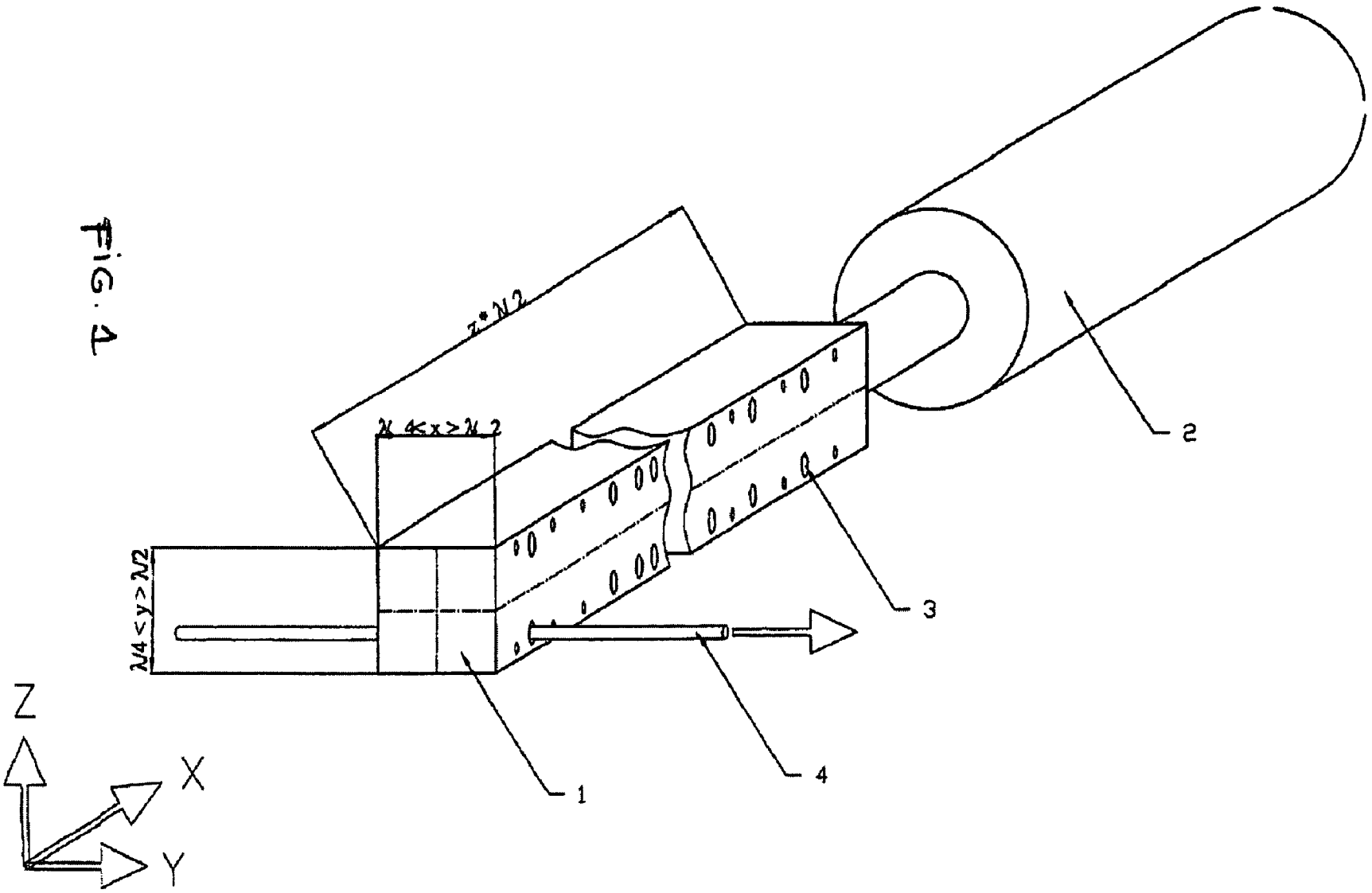

ULTRASONIC CLEANING SYSTEM FOR CLEANING A PLURALITY OF PARALLEL EXTENDING, STRAND LIKE PRODUCTS, SUCH AS EXAMPLE WIRE, PROFILES AND PIPES

The invention concerns an arrangement for ultrasound cleaning of several strandlike articles moving alongside each other, such as, e.g., wires, profiles and pipes, by means of a liquid excited by ultrasound, according to the preamble of claim 1.

It is already known how to clean several strandlike articles moving alongside each other by means of ultrasound and liquid.

The cleaning effect, as with all ultrasonic cleaning processes, is based on the principle of cavitation. For this, ultrasound energy is beamed into the cleaning liquid, which surrounds or flushes the material being cleaned. Cavitation occurs in the liquid, i.e., the liquid is broken up as a result of the high energy, and bubbles are formed, whose interior is filled with gas under a partial vacuum. The gas bubbles implode, releasing high energy and creating a strong microcurrent. This current acts on the soiled surface of the material being cleaned and removes residue such as fats, oils, stearates, dust and the like.

One of the known methods of beaming ultrasound energy into liquids with the objective of cleaning of several strandlike articles moving alongside each other includes immersible plate transducers, which are introduced into liquid-filled containers. The ultrasound energy of the immersible transducer is beamed into the cleaning liquid over a large surface by using low amplitudes of oscillation, i.e., up to 2 micrometers (μm), and low sonic power densities relative to the surface area, i.e., up to 1 watt per square centimeter ($W/cm^2$). In the methods and arrangements based on these immersible plate transducers, the strandlike articles being cleaned and traveling next to each other are drawn through the liquid of a large container, generally a basin or pool. Due to the low surface sonic power densities of up to 1 $W/cm^2$, only low volumetric sonic power densities of around 15 watts per liter (W/1) on average get into the liquid, because of the large volume of a cleaning pool. The volume of liquid of the cleaning pool associated with the size necessary for these cleaning purposes furthermore requires a high energy input. The power effective for cleaning at the surface of the wire is far below the total power of the ultrasound pool, because the ultrasound is not sufficiently targeted, i.e., it does not act at the surface of the material being cleaned, so that a high energy input becomes necessary to achieve the cleaning effect.

Methods are known from U.S. Pat. No. 4,100,926 and U.S. Pat. No. 4,046,592 in which a generally familiar cylindrical sonotrode is used, in which a conduit is made through which the wire being cleaned is guided. The cleaning liquid is brought into contact with the material being cleaned in chambers and in the conduit. In both instances the sonotrode must excite a relatively large volume of water, so that the sonic energy concentration is too low to achieve a sufficient cleaning power. Here as well, the ultrasound energy is not concentrated on a small volume around the surface of the material being cleaned. In the known methods, environmentally burdensome acidic or alkaline detergents are often used to support the inadequate ultrasound cleaning power.

In U.S. Pat. No. 4,788,992 a device is described for cleaning of strips, with which only slightly better cleaning effects can be achieved, yet which is unsuitable and ineffective for wire cleaning. In this arrangement, the band or the strips being cleaned are taken in a cleaning chamber between two separate plate transducers oscillating at different frequencies. A cleaning fluid flows between the plates and is excited by the oscillations of the membrane plates, acting on the surface of the strip being cleaned. For technological reasons, i.e., the nature of the material and the necessarily small thickness, as well as the geometry of the plates, the plate transducers can only be used for low amplitudes and thus for small sonic power surface densities and therefore also only for small sonic power volumetric densities, and only for strip-type products. The cleaning effect is not satisfactory and is unsuitable for use with round cross sections for the products being cleaned, such as, e.g., wires and pipes. The width of the plate transducers does not take effect on the curved surface of round cross sections. The sonic power directly beamed in is utilized only in a small region. Several ultrasound transducers must be employed for the cleaning.

From DE 196 02 917 C2 are known a method and a device according to which the product being cleaned is taken through a borehole, adapted to the diameter of the product, of an ultrasonic sonotrode vibrating in air, into which cleaning liquid is admitted.

In DE 197 06 007 C2 a method is described wherein the product being cleaned is taken through a borehole of a special flexural resonator vibrating in air, which is excited to vibrate by an ultrasound sonotrode, into which cleaning fluid is admitted.

Thanks to this method, a small [volume] surrounding or flowing around the material being cleaned is already very intensively excited by ultrasound directly in a working borehole of the specially configured sonotrode. Due to the possible high amplitudes and the associated high sonic power surface density, a very high sonic power volumetric density is created in the described small volume. The resulting intense field of cavitation has a very direct and effective [action].

Several strandlike products traveling alongside each other, such as, e.g., wires, pipes, profiles, or the like, with a cross section diagonal of several centimeters, cannot be cleaned by the above methods.

The object of the invention is to develop an arrangement for ultrasound cleaning of several strandlike articles traveling alongside each other, such as, e.g., wires, profiles and pipes, which guarantees that the ultrasound introduced from an ultrasonic transducer acts directly on the article being cleaned and an efficient cleaning is achieved in that only the volume of liquid necessary for the cleaning is excited by ultrasound, and each individual strandlike article traveling alongside each other should be exposed to the ultrasound as evenly as possible.

The solution to this object results from the features of claim 1.

Accordingly, the arrangement of the invention is characterized in that, in an ultrasound sonotrode vibrating in air along its lengthwise axis (x axis) with a thickness of more than $\lambda/4$, boreholes are arranged transversely (y axis) to the main direction of oscillation (x axis) of the sonotrode to accommodate the article being cleaned, being situated at the outer edge of the sonotrode and approximately in a row and at any given interval from each other, so that the cleaning liquid in the boreholes is excited both by the oscillations along the main direction of oscillation (x axis) and by the thickness oscillations of the sonotrode material transversely to the main direction of oscillation (z axis), and the cleaning liquid is supplied to the boreholes such that it completely fills them.

Thanks to the use of a special thick sonotrode with a plurality of boreholes at the outer margin of the sonotrode vertical to the plane of excitation (x axis), through which the article being cleaned is taken, one accomplishes an efficient cleaning with a single ultrasound transducer of high power, for example, four kilowatts, by the action of thickness oscillations (z axis) in the boreholes at the oscillation node and lengthwise oscillations (x axis) in the boreholes at the oscillation maximum and mixed forms of oscillations in the boreholes in between.

By concentrating the liquid volume effective for the cleaning in the working boreholes of the thick sonotrode, the introduced ultrasound power is concentrated on this small volume, so that an intense field of cavitation is produced with little energy expenditure, in which a highly effective cleaning of the article moving through is guaranteed. The ultrasound acts inside the working boreholes from all sides at slight distance intensively on the surface of the material being cleaned. One accomplishes a sonic power surface density which is 20 to 100 times that of the known methods, so that a substantially higher cleaning speed is achieved with a comparable energy outlay, for example, when cleaning wire. Moreover, there is a saving on cleaning liquid, a smaller installation is needed, and one achieves a higher speed of throughput of the material being cleaned. The environmental burden is reduced by the more efficient energy usage and less consumption of cleaning additives.

The arrangement of the invention can be used for the efficient cleaning of several strandlike articles moving alongside each other, such as, e.g., wires, profiles and pipes, but also for several flexible cords.

One can select and employ the proper ultrasound power for each cross section or for each kind of material. The oscillation amplitude of the sonotrode can be adjusted to the particular application.

Additional advantageous configurations of the invention result from the features of the subclaims.

The invention is explained more closely hereafter by means of an example of embodiment of a thick sonotrode, depicted in the single FIGURE.

In the single FIG. 1, in schematic cross section, there is represented an ultrasound sonotrode 1, which is excited by an ultrasound transducer 2 into ultrasonic oscillations US along its lengthwise axis (x axis).

The sonotrode 1 is chosen to be a "thick" sonotrode with a rectangular or approximately rectangular cross section having a thickness of $\lambda/4$ to $\lambda/2$, so that one will achieve effectiveness both as a longitudinal oscillator and a thickness oscillator.

In boreholes 3 arranged at the oscillatory node of the ultrasonic oscillations US, when the boreholes are suitably arranged, there occur thickness oscillations (z axis), and in boreholes 3 arranged at the oscillation maximum there occur longitudinal oscillations (x axis). In the boreholes 3 arranged in between, depending on the distance of the borehole 3 from the oscillation maximum, there occur superpositionings of longitudinal oscillation components (x axis) and thickness oscillation components (y axis). In this way, one assures that each borehole 3 experiences an almost equal exposure to ultrasound power.

In order to compensate for any nonuniform ultrasound exposures occurring in the boreholes 3, which would produce a nonuniform cleaning of the articles traveling alongside each other, one can arrange two sonotrodes 1 staggered one behind the other.

The length of the sonotrode 1 is any given multiple of $\lambda/2$.

The sonotrode 1 has a plurality of boreholes 3 in the upper and lower edge region along the lengthwise axis (x axis), through which the product being cleaned is taken, e.g., several wires 4 traveling next to each other.

The boreholes 3 can have different diameters and be arranged at variable distances from the outer edge of the sonotrode 1, wherein it is appropriate to select a distance between the outer edge of the borehole and the outer edge of the sonotrode 1 to be between around 2 mm and 8 mm, and the distance between the boreholes 3 can be chosen variously.

The boreholes 3 of one row at the outer edge of the sonotrode 1 are sufficient for the functioning of the arrangement.

The second row of boreholes 3, which should contain boreholes each symmetrically arranged relative to the center axis of the sonotrode 1, serves to increase the lifetime of the sonotrode 1, which is subject to wear by virtue of the cavitational action. Furthermore, it serves to maintain the symmetry conditions for the propagation of sound. When the boreholes 3 on one side become worn, the sonotrode 1 can be turned over and continue to be used with the boreholes 3 on the other side.

If an ultrasound processor 2 sufficiently dimensioned for the particular application is hooked up to the sonotrode 1, then the cleaning liquid introduced into the boreholes 3 will begin to oscillate and the oscillations will be transmitted by the liquid to the surface of an article introduced concentrically through the boreholes 3. One should make sure that the liquid completely fills the boreholes 3.

Thanks to the concentration of the ultrasound power beamed in onto the small volume in the boreholes 3 and especially the volume between the wall of the boreholes 3 and the strandlike articles concentrically led into the boreholes 3, a very intense field of cavitation is formed, in which a very intense cleaning of all grime from the surface of the wire occurs. The dissolved impurities are flushed out with the cleaning liquid to the other side of the boreholes 3. The cleaning liquid can be returned to the process after an appropriate workup.

The sonotrode 1 oscillates in air with an amplitude adjusted to the article being cleaned. The sonotrode 1 is preferably rectangular, but one can also use a round sonotrode 1.

The performance capability is illustrated hereafter by a concrete embodiment of the installation according to the invention.

If, for example, a frequency of twenty kilohertz is used, then $\lambda/2$ is roughly 125 mm when titanium is used as the sonotrode material. The sonotrode 1 is chosen with a cross section of, for example, 100 mm×100 mm and any desired length of a multiple of $\lambda/2$, for example, 2000 mm. There are 100 boreholes 3, for example, arranged in the sonotrode 1 with a diameter of 10 mm for each row. If the ultrasonic transducer 2 is operated with a power of four kilowatts, then each borehole 3 is exposed to around 40 watts of ultrasound power. This corresponds to a power of around 14 watt/$cm^3$ of borehole volume. The borehole volume is around 7.85 $cm^3$ and is further reduced by around 5 $cm^3$ in the case of a wire of 8 mm diameter, so that one needs to excite around 2.85 $cm^3$ of cleaning liquid for each borehole 3.

Cleaning baths used in the prior art accomplish a sonic power volumetric density of 0.015 to 0.03 watt/$cm^3$.

LIST OF REFERENCE NUMBERS

| | |
|---|---|
| 1 | ultrasound sonotrode |
| 2 | ultrasound transducer |
| 3 | boreholes |
| 4 | wire (article being cleaned) |

The invention claimed is:

1. An arrangement for ultrasound cleaning of several strandlike articles traveling next to each other, such as, e.g., wires, profiles and pipes, by means of a liquid excited by ultrasound in a borehole, which is only slightly larger, i.e., around 5-50% larger than the diameter of the article being cleaned, wherein the cleaning liquid is taken to the boreholes in such a way that it fills them completely, is hereby characterized in that, in an ultrasound sonotrode oscillating in air along its lengthwise axis (x axis) with a thickness of more than λ/4, boreholes are arranged transversely (y axis) to the main direction of oscillation (x axis) of the sonotrode to accommodate the article being cleaned, which are situated at the outer edge of the sonotrode and approximately in a row and at any desired interval from each other, so that the cleaning liquid in the boreholes is excited both by the oscillations along the main direction of oscillation (x axis) and by the thickness oscillations of the sonotrode material transversely (z axis) to the main direction of oscillation.

2. The arrangement according to claim 1, further characterized in that the distance of the outer edge of the particular borehole from the outer edge of the sonotrode is chosen to be around 2 mm to 8 mm.

3. The arrangement according to claims 1 or 2, further characterized in that, in order to increase the lifetime of the sonotrode and to maintain conditions of symmetry in the propagation of sound, the boreholes are arranged in two rows in relation to the center axis/lengthwise axis of the sonotrode, essentially symmetrical to each other.

4. The arrangement according to claim 3, further characterized in that the sonotrode has a rectangular profile.

5. The arrangement according to claim 3, further characterized in that two sonotrodes are arranged staggered one after the other, in order to compensate for any nonuniform ultrasound exposures occurring in the boreholes.

6. The arrangement according to claim 2 further characterized in that the sonotrode has a rectangular profile.

7. An arrangement 2 for ultrasound cleaning of several strandlike articles traveling next to each other, such as, e.g., wires, profiles and pipes, by means of a liquid excited by ultrasound in a borehole, which is only slightly larger, i.e., around 5-50% larger than the diameter of the article being cleaned, wherein the cleaning liquid is taken to the boreholes in such a way that it fills them completely, is hereby characterized in that, in an ultrasound sonotrode oscillating in air along its lengthwise axis (x axis) with a thickness of more than λ/4, boreholes are arranged transversely (y axis) to the main direction of oscillation (x axis) of the sonotrode to accommodate the article being cleaned, which are situated at the outer edge of the sonotrode and approximately in a row and at any desired interval from each other, so that the cleaning liquid in the boreholes is excited both by the oscillations along the main direction of oscillation (x axis) and by the thickness oscillations of the sonotrode material transversely (z axis) to the main direction of oscillation, further characterized in that the distance of the outer edge of the particular borehole from the outer edge of the sonotrode is chosen to be around 2 mm to 8 mm and, further characterized in that two sonotrodes are arranged staggered one after the other, in order to compensate for any nonuniform ultrasound exposures occurring in the boreholes.

8. The arrangement according to claim 1 further characterized in that the sonotrode has a rectangular profile.

9. An arrangement for ultrasound cleaning of several strandlike articles traveling next to each other, such as, e.g., wires, profiles and pipes, by means of a liquid excited by ultrasound in a borehole, which is only slightly larger, i.e., around 5-50% larger than the diameter of the article being cleaned, wherein the cleaning liquid is taken to the boreholes in such a way that it fills them completely, is hereby characterized in that, in an ultrasound sonotrode oscillating in air along its lengthwise axis (x axis) with a thickness of more than λ/4, boreholes are arranged transversely (y axis) to the main direction of oscillation (x axis) of the sonotrode to accommodate the article being cleaned, which are situated at the outer edge of the sonotrode and approximately in a row and at any desired interval from each other, so that the cleaning liquid in the boreholes is excited both by the oscillations along the main direction of oscillation (x axis) and by the thickness oscillations of the sonotrode material transversely (z axis) to the main direction of oscillation, further characterized in that, in order to increase the lifetime of the sonotrode and to maintain conditions of symmetry in the propagation of sound, the boreholes are arranged in two rows in relation to the center axis/lengthwise axis of the sonotrode, essentially symmetrical to each other, further characterized in that the sonotrode has a rectangular profile, further characterized in that two sonotrodes are arranged staggered one after the other, in order to compensate for any nonuniform ultrasound exposures occurring in the boreholes.

10. An arrangement for ultrasound cleaning of several strandlike articles traveling next to each other, such as, e.g., wires, profiles and pipes, by means of a liquid excited by ultrasound in a borehole, which is only slightly larger, i.e., around 5-50% larger than the diameter of the article being cleaned, wherein the cleaning liquid is taken to the boreholes in such a way that it fills them completely, is hereby characterized in that, in an ultrasound sonotrode oscillating in air along its lengthwise axis (x axis) with a thickness of more than λ/4, boreholes are arranged transversely (y axis) to the main direction of oscillation (x axis) of the sonotrode to accommodate the article being cleaned, which are situated at the outer edge of the sonotrode and approximately in a row and at any desired interval from each other, so that the cleaning liquid in the boreholes is excited both by the oscillations along the main direction of oscillation (x axis) and by the thickness oscillations of the sonotrode material transversely (z axis) to the main direction of oscillation, further characterized in that two sonotrodes are arranged staggered one after the other, in order to compensate for any nonuniform ultrasound exposures occurring in the boreholes.

* * * * *